US012753997B2

(12) United States Patent
Williams

(10) Patent No.: US 12,753,997 B2
(45) Date of Patent: Oct. 6, 2026

(54) UTILIZING A WEAPONS PORT WHICH USES A SINGLE PENETRATION

(71) Applicant: Howe & Howe Inc., Waterboro, ME (US)

(72) Inventor: Matthew Gregory Williams, Kennebunk, ME (US)

(73) Assignee: HOWE & HOWE INC., Waterborò (ME)

( * ) Notice: Subject to any disclaimer, the term of this patent is extended or adjusted under 35 U.S.C. 154(b) by 0 days.

(21) Appl. No.: 19/019,961

(22) Filed: Jan. 14, 2025

(65) Prior Publication Data

US 2025/0251222 A1 Aug. 7, 2025

Related U.S. Application Data

(60) Provisional application No. 63/550,337, filed on Feb. 6, 2024.

(51) Int. Cl.
*F41H 5/26* (2006.01)
*F41H 7/02* (2006.01)

(52) U.S. Cl.
CPC *F41H 5/26* (2013.01); *F41H 7/02* (2013.01)

(58) Field of Classification Search
CPC ..... F41H 5/26; F41H 7/02
See application file for complete search history.

(56) References Cited

U.S. PATENT DOCUMENTS 1,161,995 A * 11/1915 Styll ..... G02B 23/08 359/405
1,203,291 A * 10/1916 White ..... F41H 5/08 89/36.03

(Continued)

FOREIGN PATENT DOCUMENTS

CN 202221276 U1 5/2012
CN 107452111 A1 12/2017

(Continued)

OTHER PUBLICATIONS

Anonymous: "Handle Nut (Mower) by Matej Kubis; Download Free STL Model; printables.com"; Jun. 6, 2019, XP093265477, retrieved from the internet on Mar. 31, 2025: https://www.printables.com/model/3511-handle-nut-mower, pp. 1-5.

(Continued)

*Primary Examiner* — Michelle Clement
(74) *Attorney, Agent, or Firm* — BainwoodHuang

(57) ABSTRACT

A blast shield or similar assembly/apparatus includes a panel and a weapons port coupled with the panel. The weapons port includes a door plate constructed and arranged to control access to a weapons port opening in a panel. The weapons port further includes a handle, and hardware constructed and arranged to couple the door plate with the handle and extend through a single penetration in the panel. The single penetration is adjacent to and separate from the weapons port opening in the panel. In some arrangements, the panel is constructed and arranged to extend outwardly from a vehicle. In some arrangements, the panel forms part of a body of a vehicle. Other arrangements are suitable as well such as the panel forming at least a portion of a wall structure, stationary partition, or similar fortified barrier, and so on.

19 Claims, 7 Drawing Sheets

(56) References Cited

U.S. PATENT DOCUMENTS

| | | | | |
|---|---|---|---|---|
| 1,212,463 | A * | 1/1917 | Doran | F41H 5/26 2/2.5 |
| 3,262,227 | A * | 7/1966 | Pentecost | E05B 65/006 49/354 |
| 4,004,494 | A * | 1/1977 | Mechulam | F41H 5/26 89/36.14 |
| 4,574,525 | A * | 3/1986 | Le Borgne | E05F 11/02 49/354 |
| 4,771,673 | A * | 9/1988 | Miller | F41H 5/26 49/386 |
| 6,425,311 | B1 * | 7/2002 | Caron | F41H 5/26 89/36.14 |
| 6,886,447 | B2 * | 5/2005 | Crotty | F41H 5/223 89/36.14 |
| 8,015,910 | B1 | 9/2011 | Fuqua et al. | |
| 8,397,618 | B2 * | 3/2013 | White | F41H 5/26 89/36.01 |
| 8,656,821 | B2 * | 2/2014 | White | F41H 5/24 89/36.01 |
| 8,950,114 | B1 * | 2/2015 | Groening | F41A 23/24 89/36.14 |
| 9,222,759 | B2 * | 12/2015 | White | F41H 5/08 |
| 9,347,748 | B1 | 5/2016 | Crisp | |
| 10,539,400 | B1 * | 1/2020 | Nibert | F41H 5/18 |
| 2025/0251222 | A1 * | 8/2025 | Williams | F41H 5/26 |

FOREIGN PATENT DOCUMENTS

| | | | |
|---|---|---|---|
| CN | 111678384 | A1 | 9/2020 |
| GB | 12462 | A1 | 4/1916 |
| JP | 5237899 | U1 | 3/1977 |

OTHER PUBLICATIONS

International Search Report and Written Opinion for PCT application No. PCT/US2025/011676, dated Apr. 15, 2025, 17 pages.

* cited by examiner

UTILIZING A WEAPONS PORT WHICH USES A SINGLE PENETRATION

CROSS REFERENCE TO RELATED APPLICATIONS

This application is a regular utility application based on earlier-filed U.S. Application No. 63/550,337 filed on Feb. 6, 2024, entitled "Utilizing a Weapons Port Which Uses a Single Penetration", the contents and teachings of which are hereby incorporated by reference in their entirety.

BACKGROUND

A typical gun port provides a mouth through which a gun may be fired. The mouth may be slightly larger than the barrel of the gun enabling the barrel to protrude through the mouth.

One conventional gun port includes a frame that defines the mouth, a rotatable knob which is integrated with the frame, and a closure plate that rotates in response to rotation of the knob. To unblock the mouth, the knob is turned thus moving the closure plate out of line with the mouth.

SUMMARY

Unfortunately, there are deficiencies to above-identified conventional gun port which uses a frame that defines the mouth. Along these lines, some frames have a non-circular form factor (e.g., a rectangular shape) and thus require a non-circular bore. However, it may be difficult to precisely drill and/or cut such a non-circular bore to properly fit the frame due to the types of materials involved (e.g., it could be challenging to drill and cut ballistic steel, carbon fiber material, combinations thereof, etc.).

Additionally, some frames may require multiple holes to properly secure the frames. Often such holes must be uniform in depth and accurately spaced apart from each other in order to properly fasten the frames in place.

In contrast to the above-identified conventional gun port which uses a frame that defines the mouth, improved techniques involve utilization of a weapons port that uses a single penetration which may be made adjacent to the weapons port opening. Such a weapons port alleviates the need to provide a non-circular bore (which could be difficult to drill/cut) within which to properly fit a frame. Additionally, such a weapons port alleviates the need for multiple holes at uniform depths and which are accurately spaced apart to correctly secure a frame. Rather, such a technique provides a simple and cost-effective option that only uses one penetration (other than the opening for the weapon itself).

One embodiment is directed to a weapons port which includes a door plate constructed and arranged to control access to a weapons port opening in a panel. The weapons port further includes a handle, and hardware constructed and arranged to couple the door plate with the handle and extend through a single penetration in the panel. The single penetration is adjacent to and separate from the weapons port opening in the panel.

Another embodiment is directed to a blast shield which includes a panel and a weapons port coupled with the panel. The weapons port includes:

(i) a door plate constructed and arranged to control access to a weapons port opening in a panel, (ii) a handle, and (iii) hardware constructed and arranged to couple the door plate with the handle and extend through a single penetration in the panel, the single penetration being adjacent to and separate from the weapons port opening in the panel.

In some arrangements, the panel is constructed and arranged to extend outwardly from a vehicle. In some arrangements, the panel forms part of a body of a vehicle. Other arrangements are suitable as well such as the panel forming at least a portion of a wall structure, stationary partition, or similar fortified barrier, and so on.

In some arrangements, the panel extends along a plane. Additionally, the hardware includes a threaded member which is constructed and arranged to extend through the single penetration to reside in a perpendicular orientation relative to the plane while mechanically linking the door plate with the handle.

In some arrangements, the hardware further includes a series of washers and nuts which installs on the threaded member to maintain the threaded member in place relative to the panel while holding the door plate and the handle at a fixed angular displacement relative to each other.

In some arrangements, the threaded member is a carriage bolt which defines a head, a threaded portion, and a square section disposed between the head and the threaded portion.

In some arrangements, a portion of the door plate defines a square hole to enable the square section defined by the carriage bolt to fit within the portion of the door plate when the carriage bolt inserts through the square hole to hold the portion of the door plate between the head defined by the carriage bolt and the panel.

In some arrangements, the series of washers and nuts includes a set of low friction washers to reduce friction between the weapons port and the panel when the set of low friction washers is installed on the threaded member.

In some arrangements, the set of low friction washers includes:

(i) a first low friction washer constructed and arranged to contact the door plate and a first side of the panel, and (ii) a second low friction washer constructed and arranged to contact a second side of the panel which is opposite the first side of the panel.

In some arrangements, the series of washers and nuts includes a set of springs constructed and arranged to impose axial force on the threaded member relative to the panel when the set of springs is installed on the threaded member.

In some arrangements, the set of springs include spring washers. Additionally, the series of washers and nuts further includes flat metal washers constructed and arranged to flank the spring washers when the flat metal washers are installed on the threaded member.

In some arrangements, the series of washers and nuts includes a castle nut constructed and arranged to secure at least a portion of the series of washers and nuts in place.

In some arrangements, the threaded member defines a cross hole which extends through the threaded member to receive a pin that, when inserted through the cross hole, engages notches of the castle nut to lock the castle nut in place on the threaded member.

In some arrangements, the castle nut has a hexagonal profile. Additionally, the handle defines a hexagonal cutout allowing the handle to fit around the castle nut and enable the handle to rotate the threaded member with the castle nut.

In some arrangements, the series of washers and nuts further includes a set of spacers constructed and arranged to position the handle relative to the castle nut along the threaded member when the set of spacers is installed on the threaded member.

In some arrangements, the series of washers and nuts further includes a locknut constructed and arranged to retain the handle on the threaded member.

In some arrangements, the series of washers and nuts includes:

(i) a set of low friction washers to reduce friction between the weapons port and the panel, (ii) a set of springs constructed and arranged to impose axial force on the threaded member relative to the panel, (iii) flat metal washers constructed and arranged to flank the set of springs, (iv) a castle nut constructed and arranged to secure at least a portion of the series of washers in place, (v) a set of spacers constructed and arranged to position the handle relative to the castle nut along the threaded member, and (vi) a locknut constructed and arranged to retain the handle on the threaded member.

In some arrangements, the set of low friction washers includes:

(i) a first low friction washer constructed and arranged to contact the door plate and a first side of the panel, (ii) a second low friction washer constructed and arranged to contact a second side of the panel which is opposite the first side of the panel.

Additionally, the set of springs include spring washers. Furthermore, the threaded member defines a cross hole which extends through the threaded member to receive a pin that, when inserted through the cross hole, engages notches of the castle nut to lock the castle nut in place on the threaded member. Also, the castle nut has a hexagonal profile, and the handle defines a hexagonal cutout allowing the handle to fit around the castle nut and enable the handle to rotate the threaded member with the castle nut.

Other embodiments are directed to systems, sub-systems and apparatus, assemblies, and so on. Some embodiments are directed to various installation methods, methods of use, methods of operation, mechanisms and/or componentry which are involved in utilizing a weapons port that uses a single penetration.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages will become apparent from the following detailed description taken in conjunction with the accompanying drawings which illustrate, by way of example, the principles of the described embodiments.

BRIEF DESCRIPTION OF THE DRAWINGS

The foregoing and other objects, features and advantages will be apparent from the following description of particular embodiments of the present disclosure, as illustrated in the accompanying drawings in which like reference characters refer to the same parts throughout the different views. The drawings are not necessarily to scale, emphasis instead being placed upon illustrating the principles of various embodiments of the present disclosure.

DETAILED DESCRIPTION

An improved technique involves utilization of a weapons port that uses a single penetration which may be made adjacent to the weapons port opening. Such a weapons port alleviates the need to provide a non-circular bore (which could be difficult to drill/cut) within which to properly fit a weapons port frame. Additionally, such a weapons port alleviates the need for multiple holes at uniform depths and which are properly spaced apart from each other to correctly secure a weapons port frame. Rather, such a technique provides a simple and cost-effective option that only uses one penetration (other than the opening for the weapon itself).

The various individual features of the particular arrangements, configurations, and embodiments disclosed herein can be combined in any desired manner that makes technological sense. Additionally, such features are hereby combined in this manner to form all possible combinations, variants and permutations except to the extent that such combinations, variants and/or permutations have been expressly excluded or are impractical. Support for such combinations, variants and permutations is considered to exist in this document.

Figure 1:
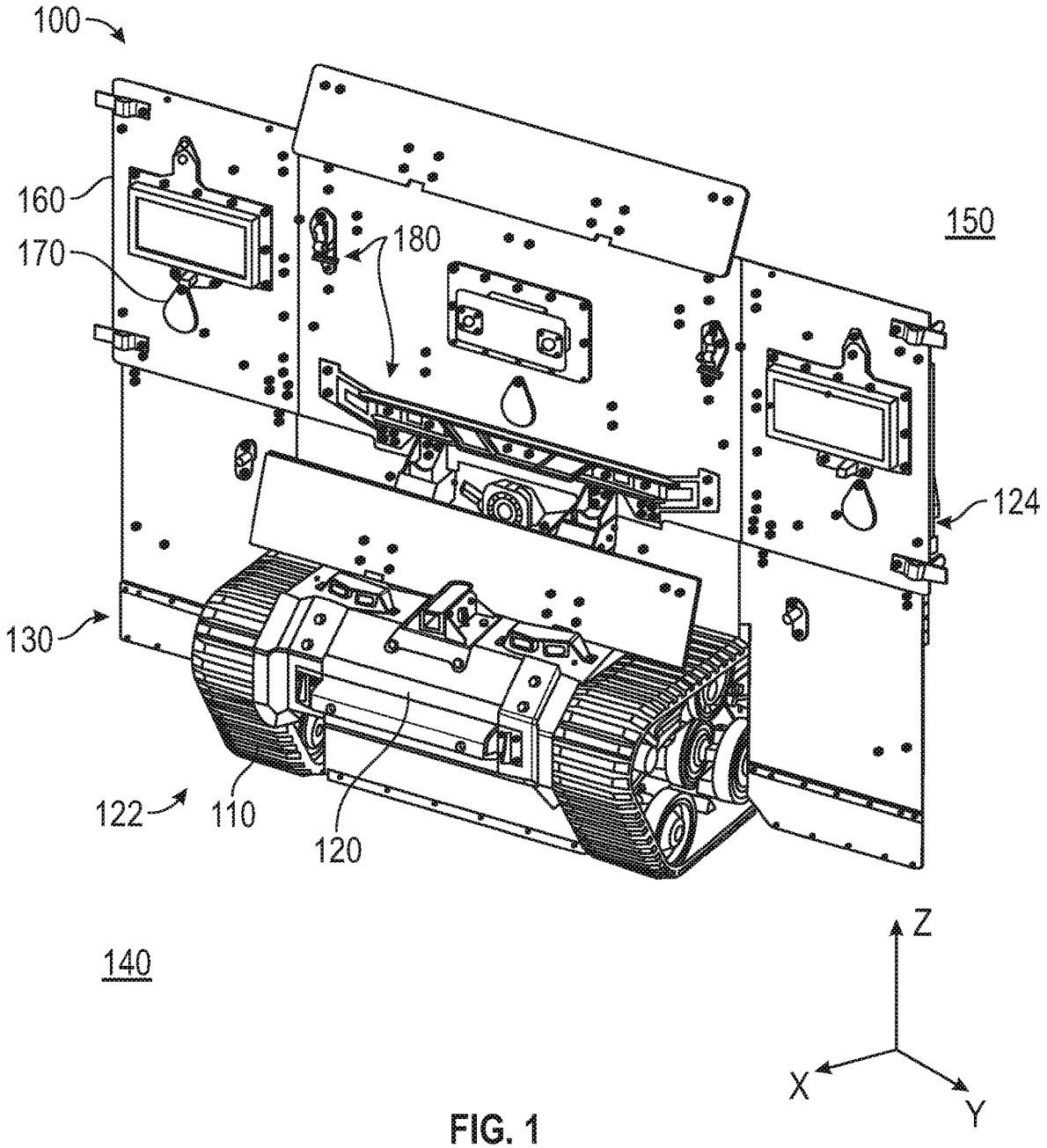
FIG. 1 is a view of a panel structure which utilizes a weapons port that uses a single penetration in accordance with certain embodiments.

FIG. 1 shows an apparatus which utilizes a weapons port that uses a single penetration which may be made adjacent to the weapons port opening in accordance with certain embodiments. By way of example, the apparatus is a tactical vehicle 100 which is constructed and arranged to move over a ground surface. However, other types of apparatus are suitable for use as well such as other types of vehicles/craft (e.g., trucks, tanks, aircraft, watercraft, etc.), walls, doors, fences, panels/partitions/shields, other types of fortified barriers/bunkers/structures, specialized equipment, combinations thereof, and so on.

The vehicle 100 includes a suspension 110 and a body 120 which couples with and is supported by the suspension 110. The body 120 defines a vehicle front 122 and a vehicle back 124. By way of example, the forward direction for the vehicle 100 is the positive X-direction in FIG. 1.

As shown in FIG. 1, the suspension 110 of the vehicle 100 supports a blast shield 130. In some arrangements, the blast shield 130 attaches to, or extends from, the body 120 of the vehicle 100. In other arrangements, the blast shield 130 is part of, or is integrated with, the body 120 of the vehicle 100.

The blast shield 130 extends outwardly from the vehicle 100 in a planar manner (e.g., extends in the Y-Z plane in FIG. 1) to provide separation between a target area 140 adjacent the vehicle front 122 and a protected area 150 adjacent the vehicle back 124. Along these lines, the blast shield 130 includes a set of wall structures 160 (i.e., one or more wall structures 160) and a set of weapons ports 170 (i.e., one or more weapons ports 170) coupled with the set of wall structures 160. The blast shield 130 may include other components 180 as well such as one or more windows, doors, supports, sensors, robotics, hardware, specialized equipment, and so on.

By way of example, the blast shield 130 includes three weapons ports 170 to enable one or more human operators to maneuver weaponry among various positions within the protected area 150. Nevertheless, it should be understood that the blast shield 130 may include a different number of weapons ports 170 (e.g., one, two, four, etc.) and that such weapons ports 170 may reside in different locations (e.g., at different heights, in different wall structures, combinations thereof, etc.).

Moreover, the various wall structures 160 may be configured to pivot, bend, unfold/refold, support attachment of other wall structures 160, combinations thereof, etc. Accordingly, the blast shield 130 enjoys maximum flexibility and customizability.

As will be explained in further detail shortly, the weapons ports 170 use single penetrations which may be made adjacent to the weapons port openings. Such a single penetration may be a simple circular aperture which is above a weapons port opening. The door plate of the weapons port 170 may be sized to provide additional tolerance due to imprecisions in penetration placement relative to the weapons port opening and/or provide margin around (or overlap) the opening to protect against spall and distribute blast load.

Accordingly, such a weapons port 170 alleviates the need to provide a non-circular bore within which to fit a frame which could be difficult to drill/cut. Furthermore, such a "frameless" weapons port 170 is simple to install (e.g., forgiving) in the sense that the weapons port 170 alleviates the need for multiple holes at uniform depths and which are properly spaced apart from each other to correctly secure a frame. Further details will now be provided with reference to FIGS. 2 through 8.

Figure 2:
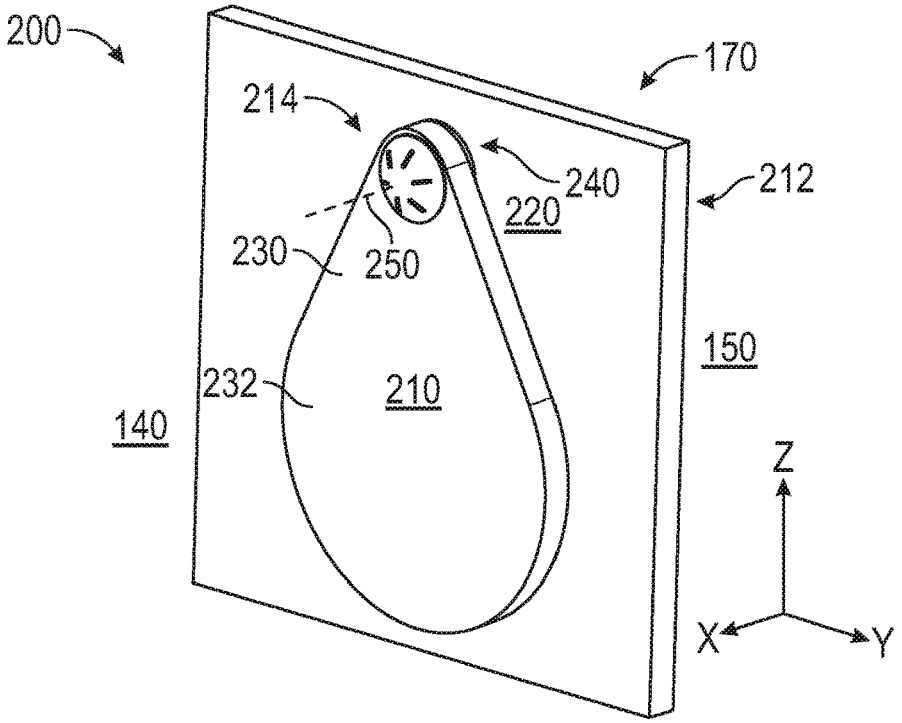
FIG. 2 is a perspective view of a first side of the weapons port while the weapons port is closed in accordance with certain embodiments.
Figure 3:
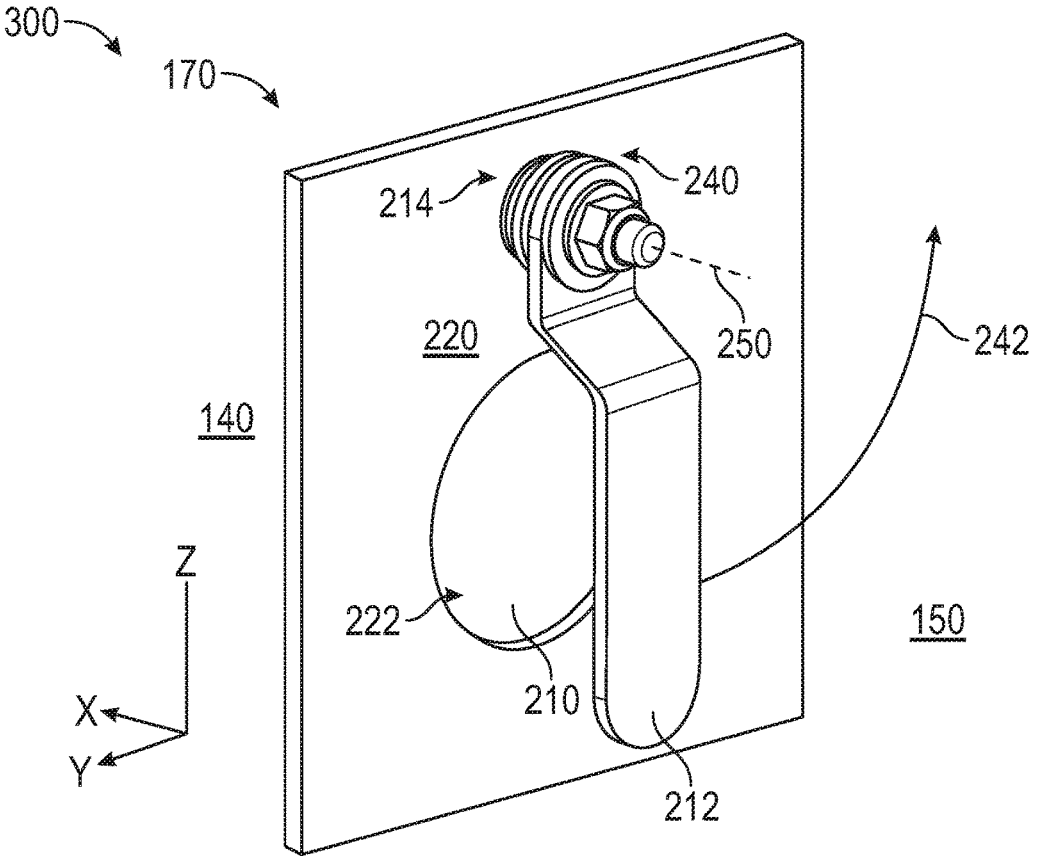
FIG. 3 is a perspective view of a second side of the weapons port while the weapons port is closed in accordance with certain embodiments.
Figure 4:
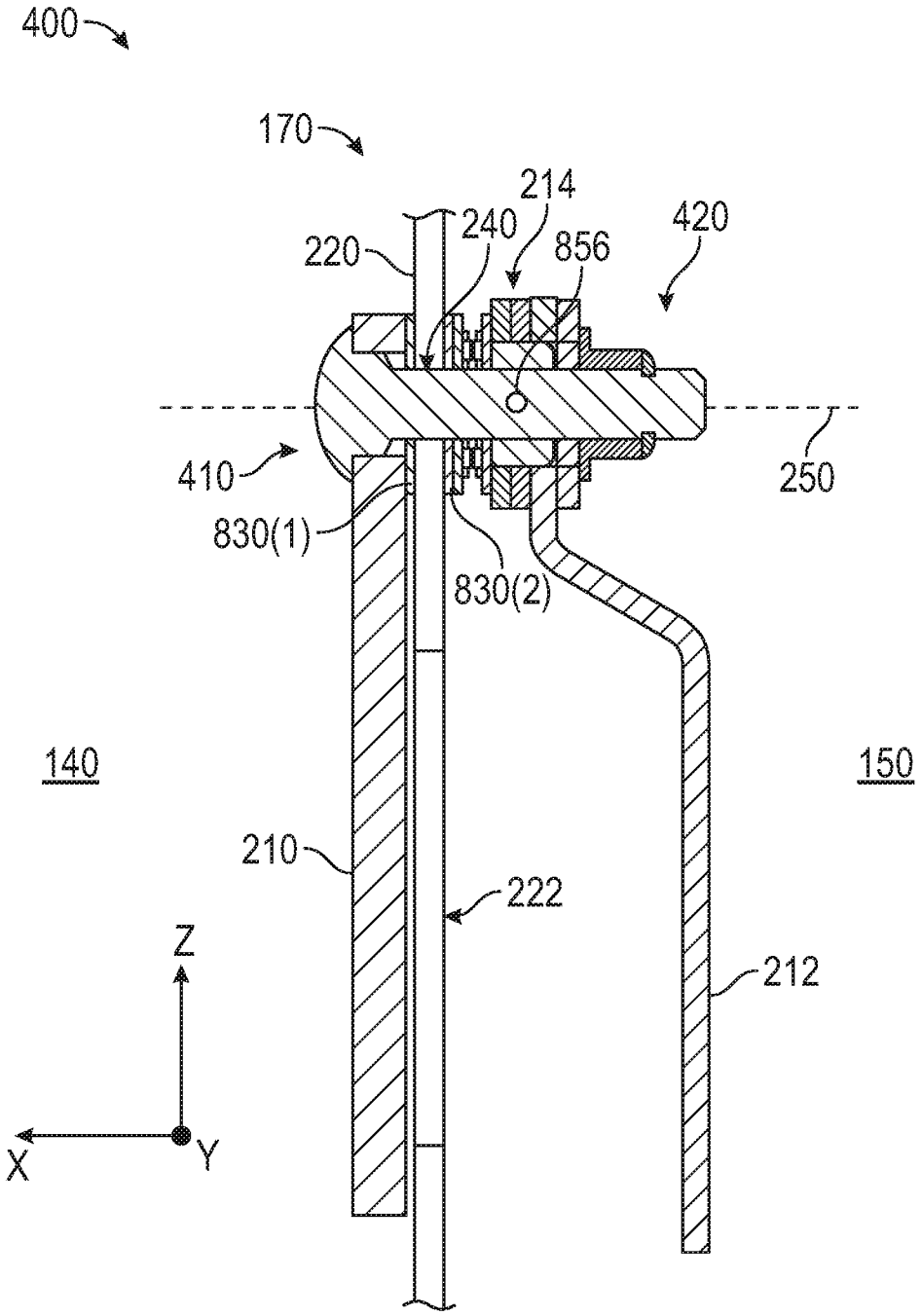
FIG. 4 is a cross-sectional side view of the weapons port while the weapons port is closed in accordance with certain embodiments.
Figure 5:
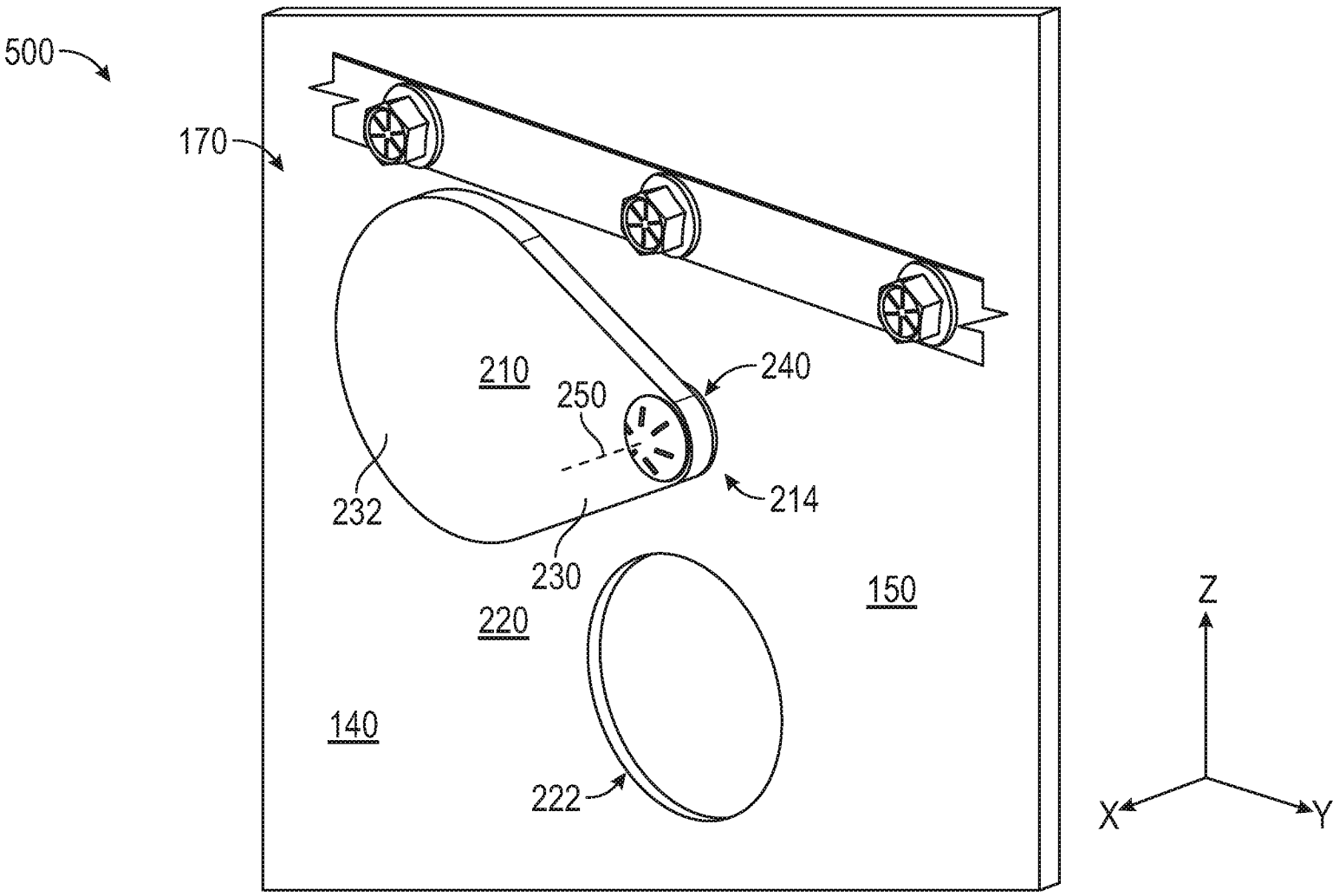
FIG. 5 is a perspective view of the first side of the weapons port while the weapons port is open in accordance with certain embodiments.
Figure 6:
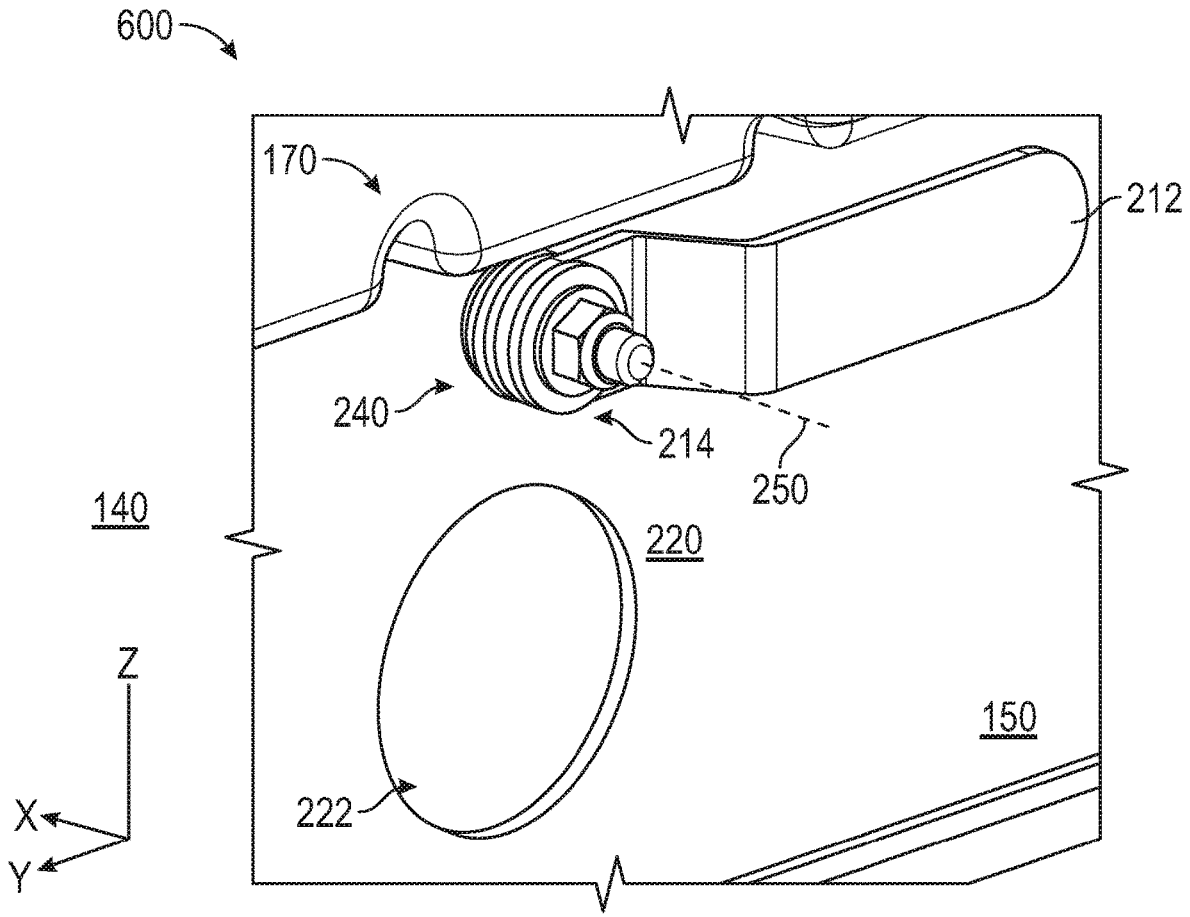
FIG. 6 is a perspective view of the second side of the weapons port while the weapons port is open in accordance with certain embodiments.
Figure 7:
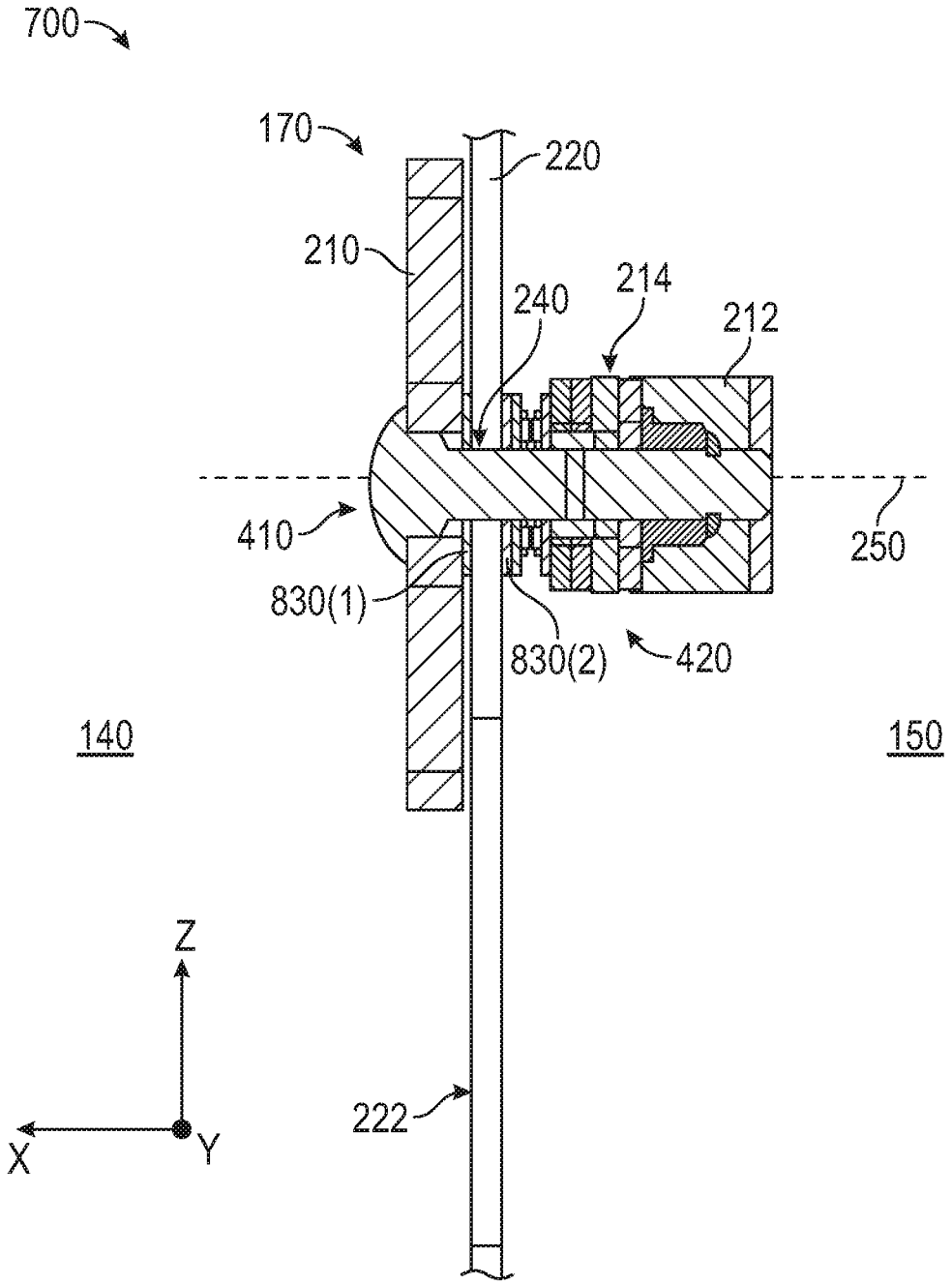
FIG. 7 is a cross-sectional side view of the weapons port while the weapons port is open in accordance with certain embodiments.
Figure 8:
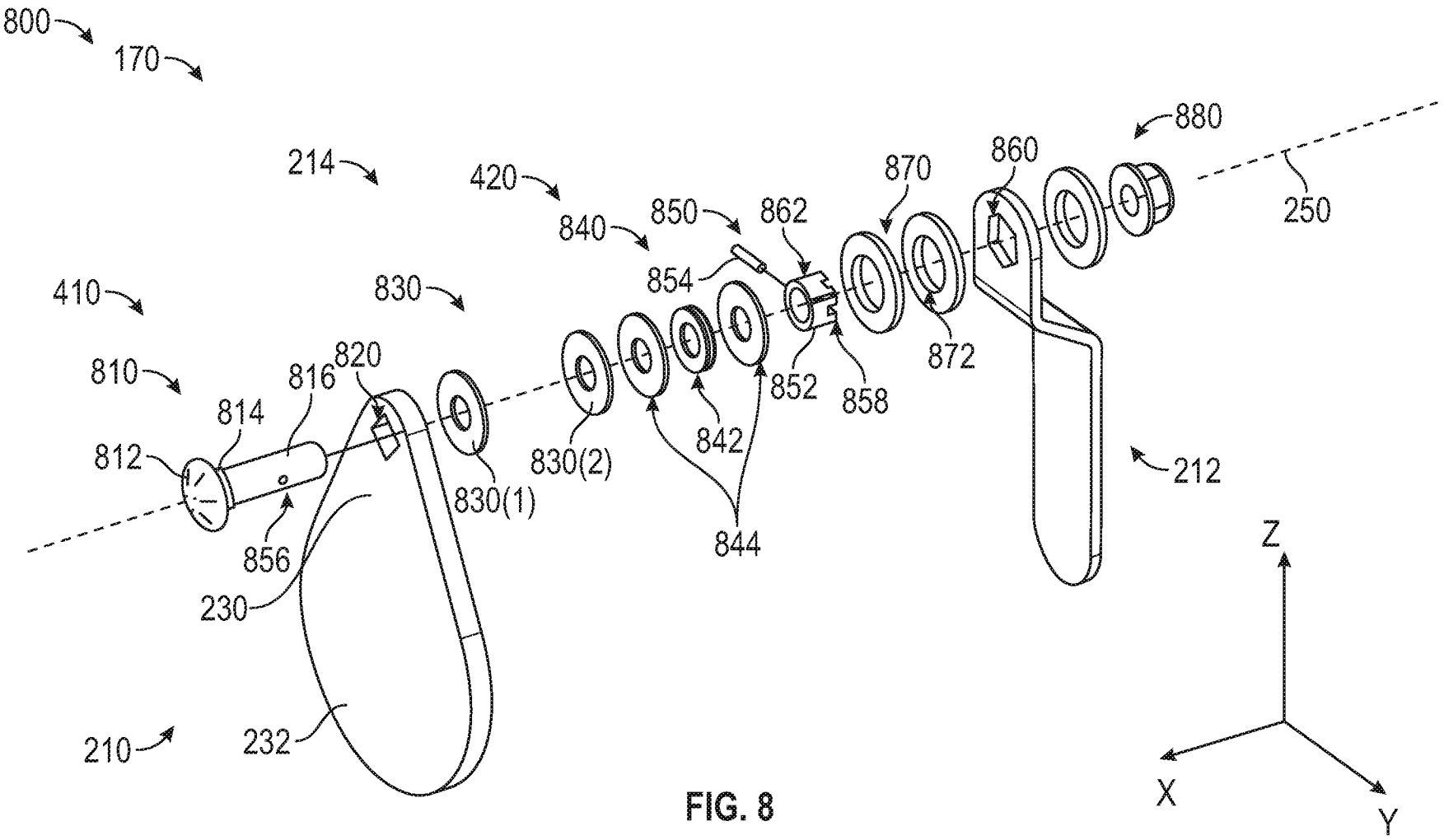
FIG. 8 is an exploded view of the weapons port in accordance with certain embodiments.

FIGS. 2 through 8 show various details of a weapons port 170 in accordance with certain embodiments. FIGS. 2 through 4 respectively show a front perspective view 200, a rear perspective view 300, and a cross-sectional side view 400 of the weapons port 170 while in a closed configuration in accordance with certain embodiments. FIGS. 5 through 7 respectively show a front perspective view 500, a rear perspective view 600, and a cross-sectional side view 700 of the weapons port 170 while in an open configuration in accordance with certain embodiments. FIG. 8 shows an exploded view 800 of the weapons port 170 in accordance with certain embodiments.

As shown in FIGS. 2 through 8, the weapons port 170 includes a door plate 210, a handle 212, and hardware 214, and installs onto a panel 220 or similar external structure (e.g., see the set of wall structures 160 in FIG. 1). The panel 220 extends in a plane (e.g., the Y-Z plane) along with the weapons port 170 to serve as a barrier between a target area 140 and a protected area 150 perhaps along with one or more other panels 220 (also see the panels 160 in FIG. 1). As will be explained in further detail shortly, the panel 220 defines a weapons port opening 222 between the protected area 150 and the target area 140 through which part of a weapon may pass.

The door plate 210 is constructed and arranged to control access to the weapons port opening 222. Along these lines, the door plate 210 generally extends along the same plane as that of the panel 220 (e.g., along the Y-Z plane) and sits relatively flush with the panel 220 to protect the weapons port opening 222. Moreover, the door plate 210 may be rotated (or turned/slid) within that plane between a first position in which the door plate 210 covers the opening 222 (see FIGS. 2 through 4) and a second position in which the door plate 210 is moved out of line with (or unblocks) the opening 222 to expose the opening 222 (see FIGS. 5 through 7).

In some embodiments, the door plate 210 sits over the weapons port opening 222 (e.g., see FIGS. 2 and 4) without forming any seal with a trim or frame that would otherwise complicate manufacturability and/or installation. Rather, the door plate 210 is able to simply reside over the weapons port opening 222 while being relatively flush with the outer surface (e.g., the side facing the target area 140) of the panel 222.

In some arrangements, the door plate 210 has a narrower attachment section 230 which attaches to the hardware 214 and a wider cover section 232 which is able to fully extend over (or conceal) the opening 222 (e.g., as measured along the Y-axis while the door plate 210 is in the position as shown in FIG. 2). Such overlap enables the door plate 210 to transfer/distribute blast load to the panel 220 if the weapons port 170 encounters blast energy from the target area 140 while the weapons port 170 is closed. In such arrangements, the door plate 210 may have a tear drop shape and hang from location above the opening 222 when covering the opening 222 (e.g., see FIGS. 2 through 4).

The handle 212 is constructed and arranged to be operated by a user positioned on the protected area 150 side of the panel 220. Along these lines, the handle 212 serves as an operable grip or lever that the user may actuate (or swing) to the left or right to move the door plate 210 out of line with the weapons port opening 222 to access the target area 140, or in line with the weapons port opening 222 to protect or guard against blast energy coming from the target area 140. It should be appreciated that other shapes and sizes are suitable for use as a component that serves as the handle 212 (e.g., a grip, a tab, a bar, a lever, a rod, a knob, and so on).

The hardware 214 is constructed and arranged to attach to the panel 220, and provide robust and reliable linkage between the handle 212 and the door plate 210. Along these lines, the hardware 214 installs through a single penetration 240 of the panel 220 along an axis 250 (e.g., the X-axis) that is perpendicular to the plane defined by the panel 220 (e.g., the Y-Z plane). When installed, the hardware 214 holds the handle 212 and the door plate 210 to the panel 220, and such that the handle 212 and the door plate 210 remain at a fixed angular displacement relative to each other so the handle 212 and the door plate 210 turn together (synchronously). Accordingly, when the user rotates the handle 212 about the axis 250 a quarter of a turn counterclockwise (see the direction of the arrow 242 in FIG. 3), the door plate 210 rotates a quarter of a turn (90 degrees) counterclockwise. Similarly, when the user rotates the handle 212 about the axis 250 a quarter of a turn in the clockwise direction (the direction opposite the arrow 242 in FIG. 3), the door plate 210 rotates a quarter of a turn in the clockwise direction, and so on.

In some arrangements, the weapons port 170 is closed when both the door plate 210 and the handle 212 extend in the downward direction (e.g., the negative Z-direction). Likewise, the weapons port 170 is open when both the door plate 210 and the handle 212 are rotated 90 degrees from the downward direction (e.g., rotated about the X-axis to be aligned with the Y-axis). Such arrangements enable the user to know the current state of the weapons port 170 based on the orientation of the handle 212. In particular, the user knows that the weapons port 170 is closed when the handle 212 points in the downward direction (the negative Z-direction), and open when the handle 212 is horizontal (e.g., aligned with the Y-axis).

As best seen in FIGS. 4, 7, and 8, the hardware 214 includes a threaded member 410 and a series of washers and nuts 420 (the actual threads are omitted from view in FIGS. 4, 7, and 8 to simply FIGS. 4, 7, and 8). The series of washers and nuts 420 installs on to the threaded member 410 to maintain the threaded member 410 in place relative to the panel 220 while holding (e.g., mechanically linking) the door plate 210 and the handle 212 at the fixed angular displacement relative to each other.

FIG. 8 is a view 800 showing certain details for the weapons port 170 in accordance with certain embodiments. The panel 220 is omitted from the view 800 for simplicity.

As shown in FIG. 8 and in some embodiments, the threaded member 410 takes the form of a carriage bolt 810 defining (or having) a head 812, a square section 814, and a threaded portion 816. The square section 814 is disposed between and interconnects the head 812 and the threaded portion 816.

In some arrangements, the attachment section 230 of the door plate 210 defines a square hole 820. Such a feature enables the square section 814 defined by the carriage bolt 810 to accurately fit within the attachment section 230 of the door plate 210 when the carriage bolt 810 inserts through the square hole 820. Accordingly, the attachment section 230 of the door plate 210 is robustly and reliably held between the head 812 defined by the carriage bolt 810 and the panel 220 (e.g., also see FIGS. 4 and 7). As a result, the door plate 210 rotates with the carriage bolt 810.

As further shown in FIG. 8 and in some embodiments, the series of washers and nuts 420 includes a set of low friction washers 830 to reduce friction between the weapons port 170 and the panel 160 (e.g., FIGS. 2 and 3) when the set of low friction washers 830 is installed on the threaded member 410 to interface with the panel 160. In particular, the set of low friction washers 830 includes a first low friction washer 830(1) constructed and arranged to contact the door plate 210 and a first side of the panel 160, and a second low friction washer 830(2) constructed and arranged to contact a second side of the panel 160 which is opposite the first side of the panel 160 (e.g., also see FIGS. 4 and 7).

In some arrangements, the set of low friction washers 830 are formed of a softer material than that of the other components (e.g., door plate 210, the panel 160, etc.) so that the set of low friction washers 830 sustain the majority of wear during operation. Such a feature enables simple replacement of the set of low friction washers 830 over (or instead of) other componentry.

As further shown in FIG. 8 and in some embodiments, the series of washers and nuts 420 includes a spring assembly 840 adjacent the second low friction washer 830(2). The spring assembly 840 includes a set of springs 842 (one or more springs 842) and outer washers 844 which flank the set of springs 842. The spring assembly 840 provides axial force (tension along the axis 250). In some arrangements, the spring assembly 840 includes multiple (e.g., two, three, etc.) spring washers (e.g., conical or disc springs) sandwiched between flat metal washers.

As further shown in FIG. 8 and in some embodiments, the series of washers and nuts 420 includes a locking assembly 850 having a castle nut 852 and a pin 854. The locking assembly 850 is constructed and arranged to secure at least a portion of the series of washers and nuts 420 in place. Along these lines, the castle nut 852 threads on to the threaded member 410 until an appropriate tension is applied by the spring assembly 840 to enable the door plate 210 and the handle 212 to stay in place via friction after the handle 212 is turned (e.g., such that the door plate 210 and the handle 212 remain in position regardless of door plate and handle angle).

To hold the castle nut 852 at this position along the threaded member 410 (i.e., to prevent the castle nut 852 from inadvertently loosening or tightening further) the pin 854 is installed through a cross hole 856 in the threaded member 410 (e.g., see the threaded portion 816 of the carriage bolt 810 in FIG. 8). In particular, while the pin 854 resides within the cross hole 856, the pin 854 engages notches 858 of the castle nut 852 to lock the castle nut 852 in place on the threaded member 410.

Such a cross hole 856 may be easily drilled through the threaded member 410 using standard equipment. In some arrangements, the cross hole 856 is sized slightly larger than the thickness of the pin 854 to enable easy tool-less insertion of the pin 854 in and/or removal of the pin 854 from the cross hole 856.

In some arrangements, the carriage bolt 810 is installed with the cross hole 856 oriented horizontally when the weapons port 170 is closed (e.g., see FIG. 4). Such a feature allows the pin 854 to be retained during the remainder of weapons port installation and reduces the chances of the pin 854 inadvertently escaping from the cross hole 856 and perhaps getting lost when uninstalling, adjusting, etc. the castle nut 852.

In some arrangements, the handle 212 defines a hexagonal cutout 860. In such arrangements, the castle nut 852 has a hexagonal profile 862. Accordingly, the handle 212 is able to accurately fit around the castle nut 852 thus enabling the handle 212 to rotate the threaded member 410 via the locked castle nut 852. As a result, the handle 212 and the door plate 210 remain at a fixed angular displacement and rotate together. It should be understood that other non-hexagonal shapes are suitable for use as well (e.g., square, octagonal, etc.).

As further shown in FIG. 8 and in some embodiments, the series of washers and nuts 420 includes a set of spacers 870 constructed and arranged to position the handle 212 relative to the castle nut 852 along the threaded member 410 when the set of spacers 870 is installed on the threaded member 410. That is, the set of spacers 870 allows for subtle tolerance/precision/stackup differences in the hardware 214 along the axis 250 (e.g., washer thicknesses, panel thickness, spring tension variations, etc.) to enable the handle 212 to be properly positioned for healthy engagement of the cutout 860 around the profile 862 of the castle nut 852.

Along these lines, the spacers 870 have inner diameters 872 which enable the spacers 870 to generally fit around/over the castle nut 852 and hold the pin 854 in position to maintain locking of the castle nut 852 relative to the threaded member 410. Such a feature holds the pin 854 within the cross hole 856 and prevents the pin 854 from inadvertently escaping from the cross hole 856.

As further shown in FIG. 8 and in some embodiments, the series of washers and nuts 420 includes an outer locknut 880 constructed and arranged to retain the handle 212 on the threaded member 410. By way of example, one or more spacers 870 of the set of spacers 870 (or similar washer) may be positioned on the outer side of the handle 212 to enable an appropriate amount of thread of the threaded member 410 to extend therefrom for proper fastening of the locknut 880 (e.g., see FIG. 8).

It should be understood that other hardware configurations are suitable for use in place of that described above in connection with FIG. 8. For example, in some arrangements, the carriage bolt 810 has a longer square section 814 that engages both the door plate 210 and the handle 212. In such arrangements, the handle 212 has a square cutout such that the handle 212 captures the square section 814, and the door plate 210 and the handle 212 are still disposed at a fixed angular displacement relative to each other.

Moreover, one or more of the series of washers and nuts 420 may be removed and/or replaced with other hardware, and/or installed in a different order. For example, the outer washers 844 which flank the set of springs 842 may be eliminated or replaced with spring washers. Similarly, one or more of the spacers 870 may be replaced with spring washers, and so on.

As described above, improved techniques involve utilization of a weapons port 170 that uses a single penetration 240 which may be made adjacent to the weapons port opening 222. Such a weapons port 170 alleviates the need to provide a non-circular bore (which could be difficult to drill/cut) within which to properly fit a frame. Additionally, such a weapons port 170 alleviates the need for multiple holes at uniform depths and which are properly spaced apart to correctly secure a frame. Rather, such a technique provides a simple and cost-effective option that only uses one penetration 240 (other than the opening 222 for the weapon itself).

While various embodiments of the present disclosure have been particularly shown and described, it will be understood by those skilled in the art that various changes in form and details may be made therein without departing from the spirit and scope of the present disclosure.

Further, although features have been shown and described with reference to particular embodiments hereof, such features may be included and hereby are included in any of the disclosed embodiments and their variants. Thus, it is understood that features disclosed in connection with any embodiment are included in any other embodiment.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Also, a "set of" elements can describe fewer than all elements present. Thus, there may be additional elements of the same kind that are not part of the set. Further, ordinal expressions, such as "first," "second," "third," and so on, may be used as adjectives herein for identification purposes. Unless specifically indicated, these ordinal expressions are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Also, and unless specifically stated to the contrary, "based on" is intended to be nonexclusive. Thus, "based on" should be interpreted as meaning "based at least in part on" unless specifically indicated otherwise. Although certain embodiments are disclosed herein, it is understood that these are provided by way of example only and should not be construed as limiting.

Those skilled in the art will therefore understand that various changes in form and detail may be made to the embodiments disclosed herein without departing from the scope of the disclosure.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

It should be appreciated that conventional weapons ports typically use componentry that requires relatively complex components, fabrication, installation, combinations thereof, and so on. For example, some conventional weapons ports require welding, special folding/bending, complex parts such as hinges, non-circular cutouts, multiple fastener holes which are precisely spaced, combinations thereof, etc. Unfortunately, these aspects make installation challenging and, if there is wear or a small amount of damage to such a weapons port, often the entire weapons port (including the frame) must be replaced.

In contrast, certain weapons port embodiments disclosed herein minimize the number of armor panel penetrations. For example, certain embodiments utilize a drilled shank carriage bolt to lock the moveable blast panel to the handle to allow retention and control of weapons port using a single hole. Moreover, in some embodiments, the ballistic panels are flat (no welding/forming required) to reduce the cost and complexity of manufacturing and replacing components.

Certain embodiments provide a simple and cost-effective option for a ballistic shield weapons port that only requires one penetration through the shield for mounting and actuation (other than the opening for the weapon itself). The operator is able to pivot open the blast door as far as desired, and the amount of resistance when opening or closing the weapons port is adjustable.

Along these lines, such a weapons port may include a blast panel (or door), a carriage bolt, and a series of washers and nuts installed on a ballistic shield panel. Such a weapons port may be supplied or offered as a kit which is simple to install on to a wall (or panel) structure provisioned with an opening for the weapon itself.

In some arrangements, the blast panel is a teardrop-shaped panel of hard ballistic material (most likely alloy steel) located on the outside of the shield panel. The lower portion of the blast panel overlaps a circular opening in the shield panel. The upper portion of the blast panel contains a square hole that fits tight around the square boss underneath the head of the carriage bolt. This effectively locks the blast panel to the carriage bolt. The edges of this square cutout are radiused to dissuade the formation of cracks when the panel is impacted. The panel is flat, which allows for simple and inexpensive manufacturing and replacement of the panel without concern of altering ballistic properties due to welding or forming.

The blast panel is secured to the shield panel using a carriage bolt. The size and material of the carriage bolt is dependent on the level of ballistic protection of the shield panel, as the head of the carriage bolt is exposed and must be able to withstand the impact from the anticipated projectiles without splitting or otherwise deforming enough to lose retention of the blast panel. The carriage bolt has a pin hole cross drilled through its shank at a location to be discussed below. Also installed on the carriage bolt is a series of washers and nuts and a handle, as described below.

Located between the blast panel and shield panel (still on the outside of the shield panel) is the first of two low-friction washers. This washer is made of a slippery, wear resistant material such as acetal. This washer reduces the coefficient of friction between stationary and sliding surfaces to allow the weapons port to open and close smoothly with a reduced level of effort. The material should be wear-resistant to prevent the need for frequent replacement but should still be softer than the blast panel and armor panel to serve as a low-cost wear item. In the event that the thickness of the blast panel is not enough to cover the full height of the square boss under the head of the carriage bolt, this outer low-friction washer may also cover the remaining height of the square boss so that the cylindrical shank of the carriage bolt passes thru the shield panel, allowing the carriage bolt to rotate relative to the shield panel.

The second low-friction washer is located against the inside of the shield panel. Like the first low-friction washer, this washer provides a smooth, replaceable wear surface between stationary and sliding parts.

After the second low friction washer, there is a pair of spring washers (such as Bellville disc spring washers) sandwiched between a pair of flat metal washers. The spring washers provide an axial force along the shank of the carriage bolt which secures the blast panel (and first low-friction washer) against the outside of the shield panel to prevent axial movement and rattling, as well as to prevent the blast panel from freely swinging. The flat metal washers provide a hard surface to compress the spring washers without the edges of the spring washers cutting or digging into the other components.

After the flat metal washers and spring washers is a castle nut, which secures the aforementioned components on the carriage bolt. The extent to which this nut is tightened determines the amount of force exerted by the spring washers, and therefore the magnitude of the friction force between the stationary and sliding parts (i.e. the amount of resistance to operate the weapons port). Once the castle nut is tightened the desired amount, it is locked in place by inserting a pin though a set of notches in the nut and the hole cross-drilled through the shank of the carriage bolt. The stackup of thicknesses of the blast panel, shield panel/wall, washers, and castle nut are what determines the distance from the head of the carriage bolt at which the pin hole is drilled. This design has a single drilled pin hole, and the carriage bolt is intended to be installed with the hole oriented horizontally when the gun port is closed (blast panel vertical). This allows the pin to be retained during the remainder of installation and reduces the chances of the pin dropping out and getting lost when uninstalling or adjusting the castle nut. Due to the number of notches on its hexagonal profile, the castle nut may be tightened in increments of ⅙ turn (60°) with a single pin hole drilled thru the carriage bolt. If finer adjustment is desired, an additional hole may be drilled perpendicular to the first hole, which reduces the adjustment increment to 1/12 turn (30°) but may require the pin to be installed vertically rather than horizontally.

After the castle nut has been installed, tightened, and pinned in place, a handle is installed over the castle nut. One or more spacers may also be installed at this time if required. The thickness of the handle plus the height of all spacers must be greater than or equal to the height of the castle nut in order to prevent axial movement of the handle. The handle contains a hexagonal cutout which fits tight to the external profile of the castle nut to retain the pin and force the castle nut to rotate with the handle. Additionally, the inner diameter of the spacers should fit tight to the external profile of the castle nut in order to retain the pin.

After the handle and any spacers are installed, a locknut is installed to retain the handle on the carriage bolt. In some arrangements, no spacer is used and the locknut installs immediately after the handle. In other arrangements, one or more spacers are installed between the handle and the locknut and/or between the flat metal washer and the handle.

To operate the weapons port, the operator simply rotates the handle. The hexagonal cutout in the handle forces the castle nut to rotate. Because the castle nut is pinned to the carriage bolt, the carriage bolt rotates as well. Because the square boss under the head of the carriage bolt is inserted into a corresponding square cutout on the blast panel, the rotation of the carriage bolt in turn causes the blast panel to rotate, pivoting it in front of or out of the way of the circular opening in the shield panel.

The various improvements described above could be utilized throughout the security industry and defense industry on armored vehicles, bunkers, and safe rooms. Such weapons port are particular suitable for armored vehicles, robotic deployable ballistic shields, bunkers, and the like.

While various embodiments of the present disclosure have been particularly shown and described, it will be understood by those skilled in the art that various changes in form and details may be made therein without departing from the spirit and scope of the present disclosure as defined by the appended claims. Such modifications and enhancements are intended to belong to various embodiments of the disclosure.

What is claimed is:

1. Weapons port, comprising:

a door plate constructed and arranged to control access to a weapons port opening in a panel;

a handle; and hardware constructed and arranged to couple the door plate with the handle and extend through a single penetration in the panel, the single penetration being adjacent to and separate from the weapons port opening in the panel;

wherein the panel extends along a plane;

wherein the hardware includes:

a threaded member which is constructed and arranged to extend through the single penetration to reside in a perpendicular orientation relative to the plane while mechanically linking the door plate with the handle; and a series of washers and nuts which installs on the threaded member to maintain the threaded member in place relative to the panel while holding the door plate and the handle at a fixed angular displacement relative to each other; and wherein the series of washers and nuts includes:

a set of springs constructed and arranged to impose axial force on the threaded member relative to the panel when the set of springs is installed on the threaded member.

2. Weapons port as in claim 1 wherein the threaded member is a carriage bolt which defines a head, a threaded portion, and a square section disposed between the head and the threaded portion.

3. Weapons port as in claim 2 wherein a portion of the door plate defines a square hole to enable the square section defined by the carriage bolt to fit within the portion of the door plate when the carriage bolt inserts through the square hole to hold the portion of the door plate between the head defined by the carriage bolt and the panel.

4. Weapons port as in claim 1 wherein the series of washers and nuts includes:

a set of low friction washers to reduce friction between the weapons port and the panel when the set of low friction washers is installed on the threaded member.

5. Weapons port as in claim 4 wherein the set of low friction washers includes:

a first low friction washer constructed and arranged to contact the door plate and a first side of the panel, and a second low friction washer constructed and arranged to contact a second side of the panel which is opposite the first side of the panel.

6. Weapons port as in claim 1 wherein the set of springs include spring washers;

wherein the series of washers and nuts further includes: flat metal washers constructed and arranged to flank the spring washers when the flat metal washers are installed on the threaded member.

7. Weapons port as in claim 1 wherein the series of washers and nuts includes:

a castle nut constructed and arranged to secure at least a portion of the series of washers and nuts in place.

8. Weapons port as in claim 7 wherein the threaded member defines a cross hole which extends through the threaded member to receive a pin that, when inserted through the cross hole, engages notches of the castle nut to lock the castle nut in place on the threaded member.

9. Weapons port as in claim 7 wherein the castle nut has a hexagonal profile; and wherein the handle defines a hexagonal cutout allowing the handle to fit around the castle nut and enable the handle to rotate the threaded member with the castle nut.

10. Weapons port as in claim 7 wherein the series of washers and nuts further includes:

a set of spacers constructed and arranged to position the handle relative to the castle nut along the threaded member when the set of spacers is installed on the threaded member.

11. Weapons port as in claim 10 wherein the series of washers and nuts further includes:

a locknut constructed and arranged to retain the handle on the threaded member.

12. Weapons port as in claim 3 wherein the series of washers and nuts includes:

a set of low friction washers to reduce friction between the weapons port and the panel, a castle nut constructed and arranged to secure at least a portion of the series of washers in place, a set of spacers constructed and arranged to position the handle relative to the castle nut along the threaded member, and a locknut constructed and arranged to retain the handle on the threaded member.

13. Weapons port as in claim 12 wherein the set of low friction washers includes:

a first low friction washer constructed and arranged to contact the door plate and a first side of the panel, a second low friction washer constructed and arranged to contact a second side of the panel which is opposite the first side of the panel;

wherein the set of springs include spring washers;

wherein the threaded member defines a cross hole which extends through the threaded member to receive a pin that, when inserted through the cross hole, engages notches of the castle nut to lock the castle nut in place on the threaded member;

wherein the castle nut has a hexagonal profile; and wherein the handle defines a hexagonal cutout allowing the handle to fit around the castle nut and enable the handle to rotate the threaded member with the castle nut.

14. A blast shield, comprising:

a panel; and a weapons port coupled with the panel, the weapons port including:

a door plate constructed and arranged to control access to a weapons port opening in a panel, a handle, and hardware constructed and arranged to couple the door plate with the handle and extend through a single penetration in the panel, the single penetration being adjacent to and separate from the weapons port opening in the panel;

wherein the panel extends along a plane;

wherein the hardware includes:

a threaded member which is constructed and arranged to extend through the single penetration to reside in a perpendicular orientation relative to the plane while mechanically linking the door plate with the handle; and a series of washers and nuts which installs on the threaded member to maintain the threaded member in place relative to the panel while holding the door plate and the handle at a fixed angular displacement relative to each other; and wherein the series of washers and nuts includes:

a set of springs constructed and arranged to impose axial force on the threaded member relative to the panel when the set of springs is installed on the threaded member.

15. The blast shield of claim 14 wherein the panel is constructed and arranged to extend outwardly from a vehicle.

16. The blast shield of claim 14 wherein the panel forms part of a body of a vehicle.

17. Weapons port, comprising:

a door plate constructed and arranged to control access to a weapons port opening in a panel;

a handle; and hardware constructed and arranged to couple the door plate with the handle and extend through a single penetration in the panel, the single penetration being adjacent to and separate from the weapons port opening in the panel;

wherein the panel extends along a plane;

wherein the hardware includes:

a threaded member which is constructed and arranged to extend through the single penetration to reside in a perpendicular orientation relative to the plane while mechanically linking the door plate with the handle; and a series of washers and nuts which installs on the threaded member to maintain the threaded member in place relative to the panel while holding the door plate and the handle at a fixed angular displacement relative to each other; and wherein the threaded member is a carriage bolt which defines a head, a threaded portion, and a square section disposed between the head and the threaded portion.

18. Weapons port as in claim 17 wherein the series of washers and nuts includes:

a set of low friction washers to reduce friction between the weapons port and the panel when the set of low friction washers is installed on the threaded member.

19. Weapons port as in claim 17 wherein the series of washers and nuts includes:

a castle nut constructed and arranged to secure at least a portion of the series of washers and nuts in place.

* * * * *